US005880442A

United States Patent [19]

You

[11] Patent Number: 5,880,442

[45] Date of Patent: Mar. 9, 1999

[54] MICROWAVE OVEN WITH STRUCTURE FOR GUIDING ELECTROMAGNETIC WAVE

[75] Inventor: Hak-Seok You, Incheon, Rep. of Korea

[73] Assignee: Daewoo Electronics Co., Ltd., Seoul, Rep. of Korea

[21] Appl. No.: 612

[22] Filed: Dec. 30, 1997

[30] Foreign Application Priority Data

Mar. 10, 1997 [KR] Rep. of Korea ..... 1997-7878

[51] Int. Cl.[6] ..... H05B 6/70

[52] U.S. Cl. ..... 219/746; 219/748; 219/756

[58] Field of Search ..... 219/746, 748, 219/749, 750, 751, 756, 695, 697; 333/227, 249

[56] References Cited

U.S. PATENT DOCUMENTS

| | | | |
|---|---|---|---|
| 3,619,536 | 11/1971 | Boehm | 219/748 |
| 3,764,770 | 10/1973 | Saad | 219/746 |
| 4,140,888 | 2/1979 | Baron et al. | 219/751 |

FOREIGN PATENT DOCUMENTS

| | | | |
|---|---|---|---|
| 30 28 009 | 2/1982 | Germany | 219/751 |
| 52-11442 | 1/1977 | Japan | 219/751 |

*Primary Examiner*—Philip H. Leung

*Attorney, Agent, or Firm*—Jacobson, Price, Holman & Stern, PLLC

[57] ABSTRACT

An electromagnetic wave generated from a magnetron of a microwave oven is dispersed into the cooking chamber from an opening through a waveguide. A first plurality of ring-shaped steps are formed radially on a top wall inside the cooking chamber. One ring-shaped step with a larger radius of the first ring-shaped steps is lower in height on the basis of a bottom surface of the cooking chamber than another ring-shaped step with a smaller radius, and a central part with the opening is highest in height. A second plurality of ring-shaped steps are formed radially on a bottom face inside the cooking chamber. The waveguide is provided with a third plurality of ring-shaped steps capable of maintaining a maximum electromagnetic field energy. Thus, the microwave is impartially dispersed while maintaining the maximum electromagnetic field energy in the cooking chamber and in the waveguide, and the cooking efficiency is largely improved.

5 Claims, 3 Drawing Sheets

MICROWAVE OVEN WITH STRUCTURE FOR GUIDING ELECTROMAGNETIC WAVE

BACKGROUND OF THE INVENTION

1. Field of the Invention

The present invention relates to a microwave oven with a structure for guiding electromagnetic wave. More particularly, the present invention relates to a microwave oven with a structure for guiding electromagnetic wave in which a microwave generated by a magnetron is dispersed with a maximum electromagnetic field intensity.

2. Prior Art

Generally, a microwave oven is a device for cooking material or foodstuff by microwave. The microwave oven is provided with an electric device chamber with a magnetron for generating microwave and a heater for generating heat. A high voltage is generated by mutual inductance of the first and second coils of a high voltage transformer, and the high voltage is applied to the magnetron to generate microwave. The microwave is irradiated to a cooking chamber through a waveguide in the microwave oven. The irradiated microwave inside the cooking chamber heats and cooks the material or foodstuff.

The conventional microwave oven will be described in detail with reference to FIG. 1 below.

FIG. 1 is a schematic cross-sectional view for showing a structure of the conventional microwave oven. In FIG. 1, a magnetron 10 generates an electromagnetic wave, and more minutely a microwave, by circuitry of the controlling part. The electromagnetic wave generated from magnetron 10 propagates through the waveguide 20. The electromagnetic wave flows into a cooking chamber 60. The cooking chamber 60 is provided with an opening 30 formed at the border with the waveguide 20, wherein the electromagnetic wave is dispersed into the cooking chamber 60 from the opening 30. A stirring fan 40 is installed in front of the opening 30 inside the cooking chamber 60.

Hereinafter, an operation of the conventional microwave oven will be described.

The electric current with the high voltage is supplied to the magnetron 10, and the microwave, for example about 2,450 MHz, is generated to be irradiated to the waveguide 20. The irradiated microwave propagates through the waveguide 20 to the opening 30. The microwave is dispersed into the cooking chamber 60 from the opening 30. The stirring fan 40 installed in front of the opening 30 is rotated, and thereby the microwave is dispersed effectively inside the cooking chamber 60.

The microwave dispersed into the cooking chamber directly travels to the foodstuff, or it collides with inside walls of the cooking chamber 60 and is then reflected from them to travel to the foodstuff. The microwave incident on the foodstuff conducts a quick molecular translation of about 2,450 million times per second to molecules constituting the foodstuff, and thereby the foodstuff is heated by the molecular motion.

According to the conventional microwave oven, the electromagnetic wave emitted from the magnetron 100, i.e., microwave, has a beam shape formed with a unidirectional flow. While the microwave proceeds along the waveguide 20, the proceeding direction of the wave changes depending on the direction of the waveguide 20. Thereafter, the wave propagates into the cooking chamber 60.

An internal structure of the cooking chamber 60 generally has a rectangular shape. Since the microwave is dispersed from the opening 30 formed at one end of the waveguide 20, the microwave propagates spherically centering about the opening 30. The electromagnetic field intensity of the microwave is in proportion to a square root of an emitted electric power and in inverse proportion to a propagated distance. Furthermore, the spherical electromagnetic field intensity of the microwave depends on the wavelength of the microwave when the emitted electric power and the propagated distance are constant respectively.

In case of the cooking chamber with the rectangular internal structure, the microwave propagated after being reflected from the corners is sharply decreased in the electromagnetic field intensity than the microwave directly propagated to the central part, and thereby the cooking efficiency largely decreases. Moreover, the electromagnetic field intensity of the microwave reaching each part of the foodstuff is different from one part or another, and thereby the heating intensity for the each part is different from one part or another.

According to the conventional microwave oven, because the internal structure of the cooking chamber is a rectangular shape, the microwave is not effectively dispersed and interference and transmission effects deteriorates. Therefore, the cooking efficiency greatly declines, the cooking time is prolonged, and the cooked condition of food may be poor.

SUMMARY OF THE INVENTION

In view of the foregoing, it is an object of the present invention to provide a microwave oven with a structure for guiding electromagnetic wave in which a microwave generated by magnetron is dispersed with a maximum electromagnetic field intensity.

To achieve the object, the present invention provides a microwave oven with a structure for guiding electromagnetic wave comprising:

a magnetron for generating an electromagnetic wave;

a waveguide for guiding the electromagnetic wave; and a cooking chamber for cooking a foodstuff by the electromagnetic wave, the cooking chamber being provided with an opening formed at a top wall for introducing the electromagnetic wave into the cooking chamber through the waveguide, a first stirring fan formed in front of the opening inside the cooking chamber for dispersing the electromagnetic wave inside the cooking chamber, and a first plurality of ring-shaped steps formed radially centering about the opening on the top wall inside the cooking chamber, in which one ring-shaped step with a larger radius of the first ring-shaped steps is lower in height on the basis of a bottom surface of the cooking chamber than another ring-shaped step with a smaller radius, and a central part with the opening is highest in height, and thereby the electromagnetic wave is dispersed into the cooking chamber through the opening while the electromagnetic wave has a maximum electromagnetic field energy by the first ring-shaped steps.

A surface of the step parallel with a surface formed by the opening is preferably ¼ of a wavelength of the electromagnetic wave in width.

In the a microwave oven with a structure for guiding electromagnetic wave of the present invention, the cooking chamber is provided with a corresponding central round part to the opening and a second plurality of ring-shaped steps formed radially centering about the central round part on a bottom face inside the cooking chamber, in which one ring-shaped step with a larger radius is higher in height on the basis of the central round part of the bottom face of the cooking chamber than another ring-shaped step with a smaller radius, and thereby the electromagnetic wave is dispersed into the cooking chamber through the opening while the electromagnetic wave has a maximum electromagnetic field energy by the ring-shaped steps.

A second stirring fan is formed in an upper part of the central round part of the bottom face of the cooking chamber.

Furthermore, in the a microwave oven with a structure for guiding electromagnetic wave of the present invention, the waveguide is provided with a third plurality of ring-shaped steps for dispersing the electromagnetic wave into the cooking chamber with a maximum electromagnetic field energy by the ring-shaped steps.

According to this microwave oven, when the microwave irradiated from the magnetron is dispersed inside the cooking chamber, the first plurality of ring-shaped steps formed radially on the top wall inside the cooking chamber serves to disperse the electromagnetic wave with the maximum electromagnetic field energy, and thereby, interference and transmission effects are increased.

Furthermore, the second plurality of ring-shaped steps formed radially on the bottom face inside the cooking chamber serve to disperse the electromagnetic wave with the maximum electromagnetic field energy, and thereby, interference and transmission effects are increased.

Moreover, because the microwave suffers from the third plurality of ring-shaped steps while passing through the waveguide, the microwave is dispersed with the maximum electromagnetic field energy in the waveguide, and thereby, interference and transmission effects are increased.

Therefore, since in the cooking chamber and in the waveguide the microwave is impartially dispersed keeping the maximum electromagnetic field energy, the cooking efficiency is largely improved, and the cooked condition of food may be good.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Hereinafter, an embodiment of the present invention will be described in detail with reference to the accompanying drawings.

Figure 1:
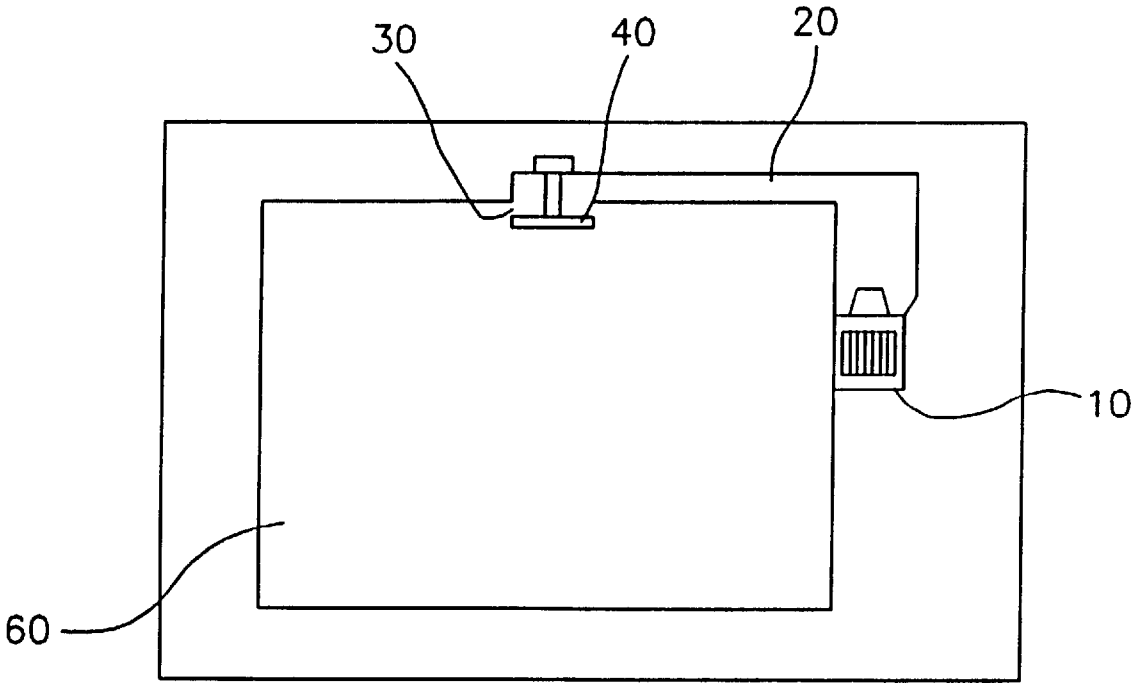
FIG. 1 PRIOR ART
FIG. 1 is a schematic cross-sectional side view for showing a conventional microwave oven.
Figure 2:
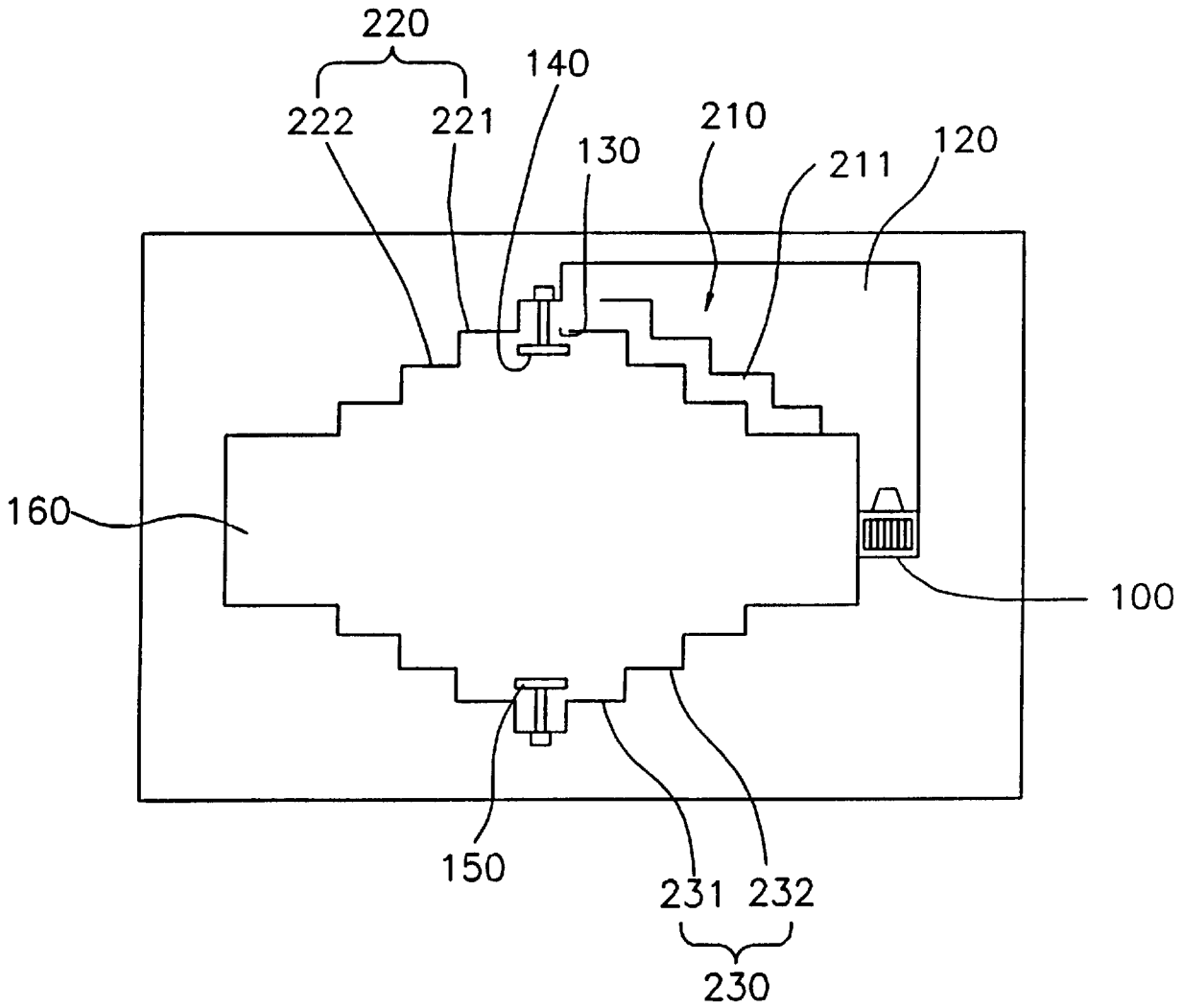
FIG. 2 is a cross-sectional side view for showing a microwave oven with a structure for guiding electromagnetic wave according to the present invention.
Figure 3:
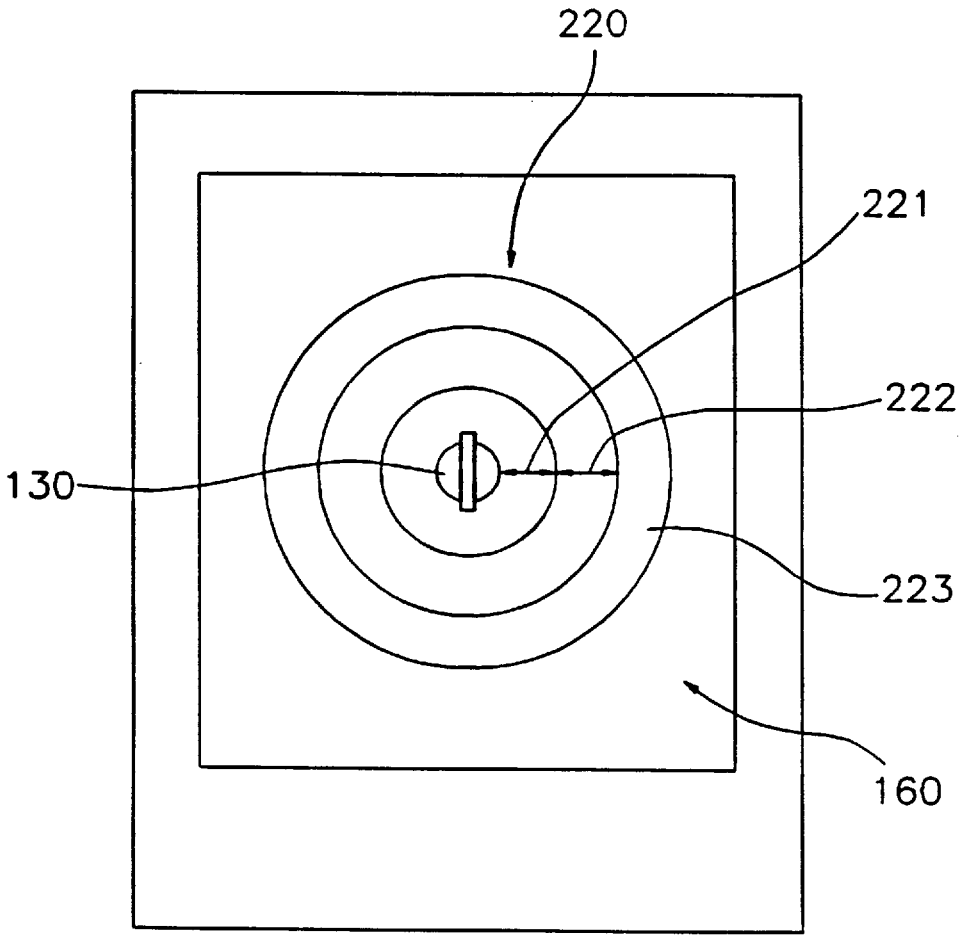
FIG. 3 is a cross-sectional plane view for showing a microwave oven of FIG. 2.

FIG. 2 is a cross-sectional side view for showing a microwave oven with a structure for guiding electromagnetic wave according to the present invention. FIG. 3 is a cross-sectional plane view for showing a microwave oven of FIG. 2.

A magnetron 100 generates an electromagnetic wave, and more minutely a microwave, by circuitry of the controlling part.

The microwave generated from magnetron 100 propagates through the waveguide 120. The waveguide 120 is provided with a third plurality of steps 210.

The electromagnetic wave propagated through the waveguide 120 flows into a cooking chamber 160. The cooking chamber 160 is provided with an opening 130 formed at the border with the waveguide 120. The electromagnetic wave is dispersed into the cooking chamber 160 from the opening 130. A stirring fan 140 is installed in front of the opening 130 inside the cooking chamber 160.

The cooking chamber 160 is provided with a first plurality of ring-shaped steps 220 formed radially centering about the opening 130 on the top wall inside the cooking chamber 160. One ring-shaped step with a larger radius 222 of the first ring-shaped steps 220 is lower in height on the basis of a bottom surface of the cooking chamber 160 than another ring-shaped step with a smaller radius 221. The cooking chamber 160 is provided with a central part in which the opening 130 height is highest.

Since the steps 220 have ring shapes, the propagated wave is reflected by the ring-shaped steps 220 at equal propagated distances. Accordingly, if a width of a surface of the step parallel with a surface formed by the opening, i.e., a width of an orthogonal surface to the propagating direction of the wave, is determined as ¼ of a wavelength of the electromagnetic wave, a spherical maximum electromagnetic field intensity can be acquired.

(1) $L=\lambda/4$ (L is a maximum value of the horizontal spherical electromagnetic field intensity, $\lambda$ is a wavelength)

(2) $\lambda=C/f$ ($\lambda$ is a wavelength, C is the velocity of light, and f is a frequency)

At this time, L is a maximum value of the horizontal spherical electromagnetic field intensity, and corresponds to the width of the surface of the step parallel with the surface formed by the opening 130. For example, when the electromagnetic wave with the frequency of 2,450 MHZ is generated, the width of the surface of the steps 221, 222 parallel with the surface formed by the opening 130 are about 0.0306 m, i.e., 3.06 cm.

Moreover, the cooking chamber 160 is provided with a corresponding central round part to the opening 130 and a second plurality of ring-shaped steps 230 formed radially centering about the central round part on a bottom face inside the cooking chamber 160. One ring-shaped step with a larger radius 232 of the second ring-shaped steps 230 is higher in height on the basis of the central round part of the bottom face of the cooking chamber 160 than another ring-shaped step with a smaller radius 231.

A second stirring fan 150 is formed in an upper part of the central round part of the bottom face of the cooking chamber 160 for dispersing the electromagnetic wave converging to the central round part.

Because the frequency is constant, among the steps 231, 232 formed on the bottom surface of the cooking chamber and the steps formed in the waveguide, widths of the surfaces parallel with the surface formed by the opening 130 are the same with the surface widths parallel with the surface formed by the opening 130 among the steps 221, 222 formed on the top surface of the cooking chamber 160.

Hereinafter, an operation of a microwave oven with a structure for guiding electromagnetic wave of the present invention will be described.

The electric current with the high voltage is supplied to the magnetron 100, and the microwave, for example about 2,450 MHz, is generated to be irradiated to the waveguide 120. The irradiated microwave propagates through the waveguide 120 to the opening 130. Since the microwave irradiated into the waveguide 120 is reflected by metal and transmitted through glass or porcelain, etc., the microwave is propagated along the curved shape of the waveguide 120. The microwave is guided to the opening 130 through the waveguide 120 while maintaining the maximum electromagnetic field energy due to the step with the width of ¼ of the wavelength of the electromagnetic wave. The surface width of the step 211 for the electromagnetic wave with the frequency of 2,450 MHZ is about 3.06 cm.

The microwave with the maximum electromagnetic field energy is irradiated into the cooking chamber 160 from the opening 130. The microwave is dispersed into the cooking chamber 160 by the first stirring fan 140 formed in front of the opening 130.

The microwave dispersed into the cooking chamber 160 maintains the maximum electromagnetic field energy due to the ring-shaped steps 221, 222 with the surface width of ¼ of the wavelength of the electromagnetic wave. The surface width of the ring-shaped steps 221, 222 for the electromagnetic wave with the frequency of 2,450 MHz is about 3.06 cm.

Meanwhile, the microwave dispersed from the opening 130 and reflected by the ring-shaped steps proceeds toward the bottom face. The microwave maintains the maximum electromagnetic field energy due to the ring-shaped steps 230 with the surface width of ¼ of the wavelength of the electromagnetic wave. The surface widths of the ring-shaped steps 231, 232 for the electromagnetic wave with the frequency of 2,450 MHZ is about 3.06 cm.

Therefore, the microwave can be impartially dispersed while maintaining the maximum electromagnetic field energy in the cooking chamber 160, the cooking efficiency is largely improved, and the cooking time is shortened.

Meanwhile, the values of widths of the above-mentioned steps are theoretical values, but values in the practical case are preferably to select the values capable of effectively dispersing the microwave with the maximum electromagnetic field energy by considering the shortening ratio of the frequency. For example, when the shortening ratio of the frequency is determined as 95%, the surface widths of the steps for the electromagnetic wave with the frequency of 2,450 MHZ is preferably about 3.06*0.95=2.907 cm.

According to the present invention, when the microwave irradiated from the magnetron is dispersed inside the cooking chamber, the first plurality of ring-shaped steps formed radially on the top wall inside the cooking chamber serve to disperse the electromagnetic wave with the maximum electromagnetic field energy, and thereby, interference and transmission effects are increased.

Furthermore, the second plurality of ring-shaped steps formed radially on the bottom face inside the cooking chamber serve to disperse the electromagnetic wave with the maximum electromagnetic field energy, and thereby, interference and transmission effects are increased.

Moreover, because the microwave suffers from the third plurality of ring-shaped steps while passing through the waveguide, the microwave is dispersed with the maximum electromagnetic field energy in the waveguide, and thereby, interference and transmission effects are increased.

Therefore, since in the cooking chamber and in the waveguide the microwave is impartially dispersed while maintaining the maximum electromagnetic field energy, the cooking efficiency is largely improved, and the cooked condition of food may be good.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. A microwave oven with a structure for guiding electromagnetic wave comprising:

a cooking chamber for cooking a foodstuff by the electromagnetic wave, the cooking chamber being provided with a central opening formed at a central part of a top wall for introducing the electromagnetic wave into the cooking chamber, a first stirring fan formed in front of the central opening inside the cooking chamber for dispersing the electromagnetic wave inside the cooking chamber;

a magnetron for generating an electromagnetic wave, which is disposed outside the cooking chamber;

a waveguide for guiding the electromagnetic wave generated by the magnetron into the cooking chamber, the waveguide having one end connected with the magnetron for receiving the electromagnetic wave generated by the magnetron and the other end connected with the central opening of the top wall of the cooking chamber for emitting the electromagnetic wave guided through the waveguide into the cooking chamber;

wherein, the cooking chamber is provided with a first plurality of ring-shaped steps formed radially centering about the central opening on the top wall of the cooking chamber, in which one ring-shaped step with a larger radius of the first ring-shaped steps is lower in height on the basis of a bottom surface of the cooking chamber than another ring-shaped step with a smaller radius, and a central part with the opening is highest in height, and thereby the electromagnetic wave is dispersed into the cooking chamber radially by the first stirring fan from the central opening while the electromagnetic wave has a maximum electromagnetic field energy due to a propagation in a radial direction of the first ring-shaped steps, and the cooking chamber is provided with a central round part formed on a bottom face thereof corresponding to the central opening of the top wall, a second stirring fan formed in an upper part of the central round part inside the cooking chamber for dispersing the electromagnetic wave inside the cooking chamber, and a second plurality of ring-shaped steps formed radially centering about the central round part on the bottom face inside the cooking chamber, in which one ring-shaped step with a larger radius is higher in height on the basis of the central round part of the bottom face of the cooking chamber than another ring-shaped step with a smaller radius, and thereby the electromagnetic wave reflected from one of the first steps toward the bottom face reaches the bottom face to be dispersed radially from the central round part by the second stirring fan while the electromagnetic wave has the maximum electromagnetic field energy due to a propagation in a radial direction of the second ring-shaped steps.

2. A microwave oven with a structure for guiding electromagnetic wave as claimed in claim 1, wherein a surface of the first step parallel with a width of a surface formed by the opening is ¼ of a wavelength of the electromagnetic wave.

3. A microwave oven with a structure for guiding electromagnetic wave as claimed in claim 1, wherein a width of a surface of the second step parallel with a surface formed by the opening is ¼ of a wavelength of the electromagnetic wave.

4. A microwave oven with a structure for guiding electromagnetic wave as claimed in claim 1, wherein the waveguide is provided with a third plurality of steps for propagating the electromagnetic wave through the waveguide in which surfaces of the third steps are formed to be parallel with each other in a direction perpendicular to a propagated direction of the wave when the wave is propagated through the waveguide, and thereby the wave is propagated to the cooking chamber with a maximum electromagnetic field energy due to the steps.

5. A microwave oven with a structure for guiding electromagnetic wave as claimed in claim 4, wherein widths of the surfaces of the third steps formed in the direction perpendicular to the propagated direction of the electromagnetic wave are ¼ of a wavelength of the electromagnetic wave.

* * * * *